United States Patent [19]

LaBate et al.

[11] Patent Number: 4,744,544

[45] Date of Patent: May 17, 1988

[54] REFRACTORY EROSION VISUAL INDICATOR

[75] Inventors: Micheal D. LaBate, Ellwood City; Joseph Perri, Coraopolis, both of Pa.; Jeffrey Towns, New Waterford, Ohio

[73] Assignee: Insul Company, Inc., East Palestine, Ohio

[21] Appl. No.: 70,057

[22] Filed: Jul. 6, 1987

[51] Int. Cl.[4] ..... C21C 5/48

[52] U.S. Cl. ..... 266/100; 266/44; 73/86

[58] Field of Search ..... 266/99, 100, 280, 281, 266/286, 283, 285, 44; 73/86

[56] References Cited

U.S. PATENT DOCUMENTS

| | | | |
|---|---|---|---|
| 3,078,707 | 2/1963 | Weaver | 266/99 |
| 3,898,366 | 8/1975 | Aurini | 73/86 |
| 4,103,539 | 8/1978 | Worley | 73/86 |
| 4,269,397 | 5/1981 | Strimple et al. | 266/44 |

FOREIGN PATENT DOCUMENTS

| | | | |
|---|---|---|---|
| 0191885 | 10/1984 | Japan | 266/99 |
| 1104009 | 5/1986 | Japan | 266/280 |
| 2000579 | 1/1979 | United Kingdom | 266/280 |

*Primary Examiner*—L. Dewayne Rutledge
*Assistant Examiner*—S. Kastler
*Attorney, Agent, or Firm*—Harpman & Harpman

[57] ABSTRACT

Refractory erosion detection devices are positioned in the refractory lining of metallurgical vessels, such as ladles and refractory stirring plugs incorporated in such vessels through which stirring gas is directed, comprise metal rods positioned in the upper or outer portions of the refractory bodies with their inner ends spaced from the opposite surfaces of the refractory body so that molten metal introduced into the metallurgical vessels erodes the refractory bodies and the metal rod to a point where the complete erosion and absence of the metal rods visually indicates the pre-determined thickness of the remaining refractory bodies indicating the need of replacement of the same.

8 Claims, 2 Drawing Sheets

REFRACTORY EROSION VISUAL INDICATOR

BACKGROUND OF THE INVENTION

1. Technical Field:

This invention relates to a method and apparatus for providing a visual indication of refractory erosion in a refractory lined metallurgical vessel.

2. Description of the Prior Art:

Prior Devices of this type are respresented by U.S. Pat. Nos. 3,078,707 on a thickness gage for a blast furnace wall, 3,898,366 on a metallurgical heating system with refractory wear indicia and 4,269,397 on a method for measuring the thickness of a refractory in a metallurgical apparatus.

In U.S. Pat. No, 3,078,707 the thickness gage comprises a pair of electrical conductors carried in a furnace wall perpendicular thereto. The conductors being spaced apart and having a plurality of resistance elements of pre-determined resistance connected therebetween in spaced relation to one another. As the furnace wall is eroded, electrical currents connected with the electrical conductors flows through the resistance elements which have different values so that the electrical current will vary depending upon the number of the resistance elements remaining in the eroding wall.

U.S. Pat. No. 3,898,366 positions electrical conductor members in the refractory lining of the metallurgical vessel so that the metal being processed forms conducting bridges between the exposed portions of the remaining electrical conductors to provide an indication of the remaining thickness of the refractory lining.

U.S. Pat. No. 4,269,397 measures the thickness of an eroded refractory lining in metallurgical apparatus by providing a central metallic electrical conductor and an outer metallic sheath spaced from a central conductor positioned in the linin so as to be subject to erosion thereof. The device erodes at substantially the same rate as the refractory and is conected by electrical connector means to an electronic instrument capable of generating stepped timed voltages or pulses through the device and receiving reflected pulses or echoes which may be visually displayed and the characteristics of which will indicate the length of the monitoring device which is substantially the same as the thickness of the refractory in which it is positioned.

SUMMARY OF THE INVENTION

The present invention is a simple combination of a refractory body in a preferred form and a metal rod or rods positioned to a known depth therein from the surface thereof exposed to molten metal in a metallurgical vessel. The metal rod or rods being visible and indicating a satisfactory remaining thickness of the refractory body and the refractory lining in which they are positioned so long as the metal rods remain. Upon their complete erosion the lack of visual indication of the rod or rods indicates the need of replacing the refractory bodies and/or the refractory lining of the metallurgical vessel. The visual observation and determination of the indicated thickness of the refractory bodies and/or refractory lining is facilitated by the red color of the red hot steel rod or rods surrounded by a circular darkening yellow color of the hot refractory in effect forming a bulls eys visual target that disappears when the metal rod or rods are completely eroded.

The invention makes it relatively simple to visually determine the remaining thickness of the refractory lining of the metallurgical vessel and/or the impact pads or stirring plugs as the case may be by visually inspecting the vessel after each heat of molten metal is poured therefrom.

DESCRIPTION OF THE DRAWINGS

FIG. 1 is a side elevation with parts broken away of a portion of a metallurgical vessel, such as a ladle, with an impact pad and a stirring plug containing visual indicators positioned therein, a stream of molten metal is diagrammatically illustrated as being poured into the vessel from a convertor or the like;

DESCRIPTION OF THE PREFERRED EMBODIMENT

Figure 1:
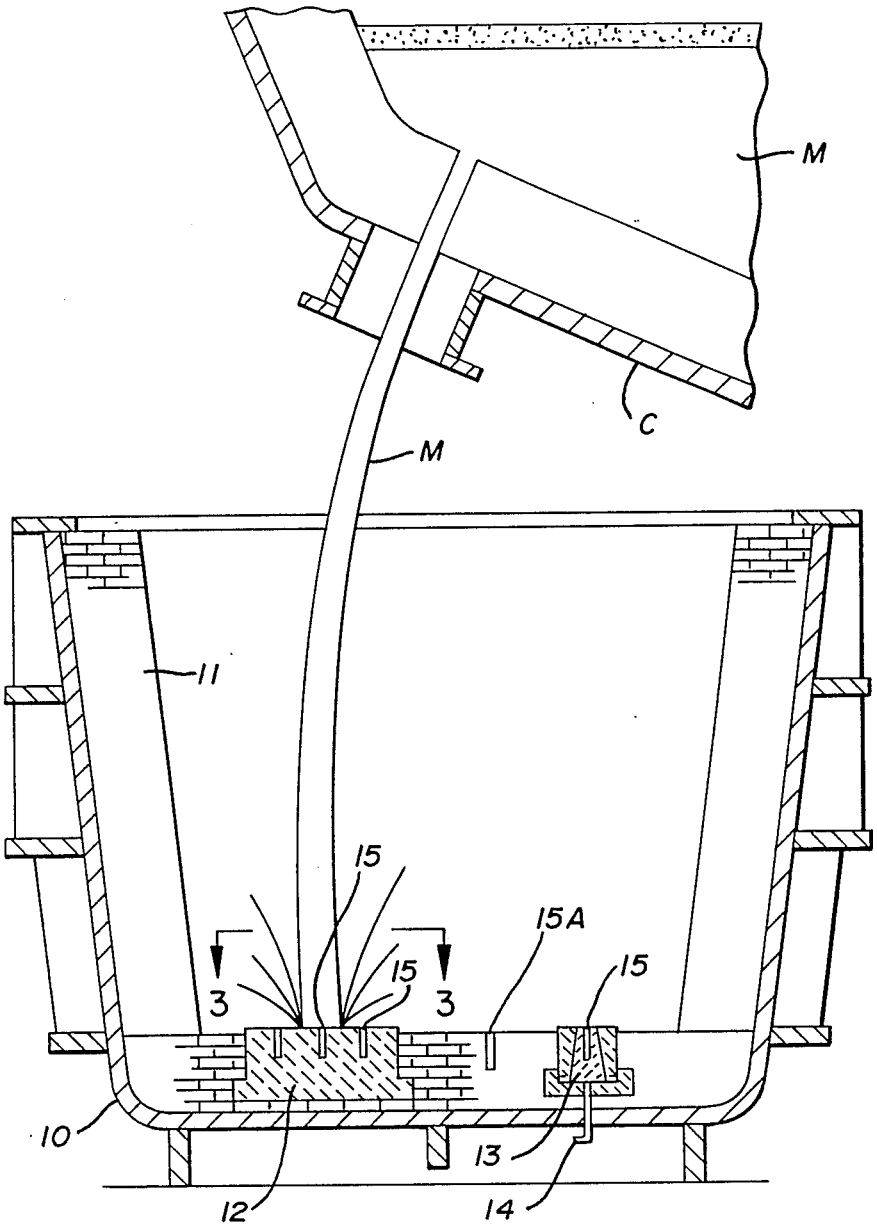
Figure 2:
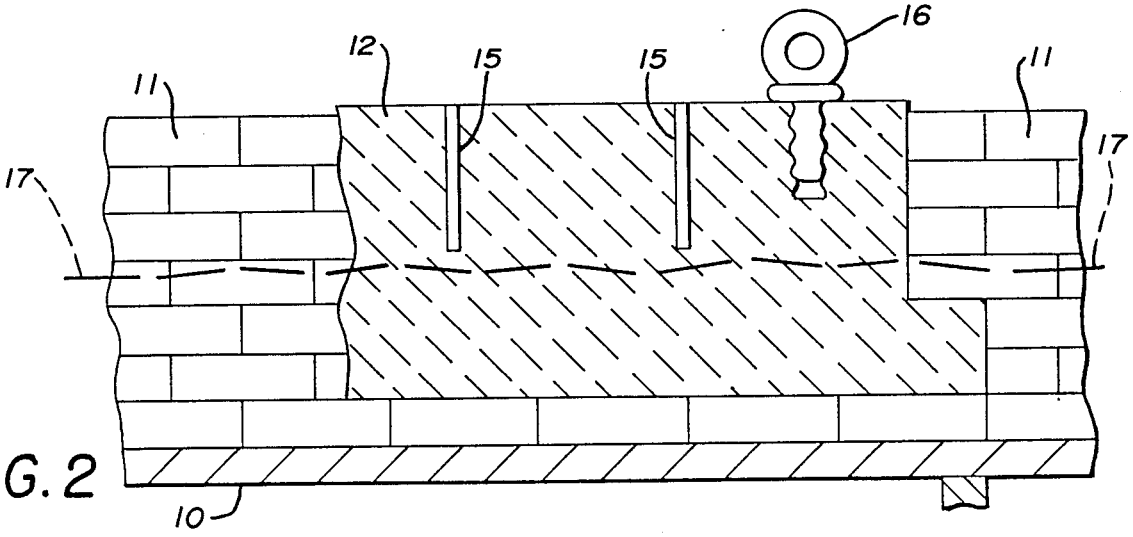
FIG. 2 is an enlarged top plan view on line 2—2 of FIG. 1.

In the form of the invention disclosed herein a metallurgical vessel, such as a ladle 10 may be seen to be provided with a refractory lining 11 such as known in the art and forming the bottom and side walls of the vessel 10. An impact pad 12 is positioned in and forms part of the refractory lining 11 in the bottom of the vessel 10 and a stirring plug 13, such as seen in the LaBate U.S. Pats. Nos. 3,396,179, 4,483,520, 4,538,795 and 4,632,367 are incorporated in the bottom portion of the lining 11 of the vessel 10. The impact pad and the stirring plug comprise refractory bodies having a known resistance to erosion of molten metal in the vessel 10 comparable with that of the lining 11 thereof. The impact pad 12 and the stirring plug 13 have one or more metal rods 15 positioned in the upper outer portions thereof extending a known distance thereinto and having a known thickness of the impact pad 12 and stirring plug 13 therebeneath. In FIG. 1 of the drawings a stream of molten metal M is diagrammatically illustrated as being poured from a converter or the like C into the vessel 10 and impacting on the impact pad 12. In FIG. 1 of the drawings a single metal rod 15A is illustrated positioned directly in the upper portion of the refractory lining 11 of the vessel 10. By referring to FIG. 2 of the drawings which is a top plan view on line 2—2 of FIG. 1, it will be seen that there are a plurality of the metal rods 15 spaced with respect to one another in the refractory body of the impact pad 12 and that the same is provided with several eyelets 16 to which support means may be attached to facilitate positioning the impact pads in the refractory lining 11 of the vessel 10. The metal rods 15 are preferrably stainless steel or equal positioned in pre-cast cavities in the refractory bodies of the impact pads 11 and 13 or bores may be drilled in the bodies and the metal rods cemented in place with suitable refractory cement.

Figure 3:
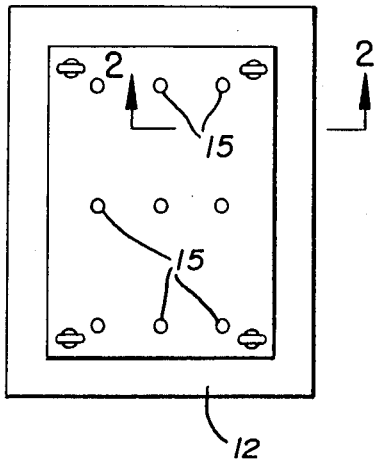
FIG. 3 is an enlarged vertical section on line 3—3 of FIG. 2.
Figure 4:
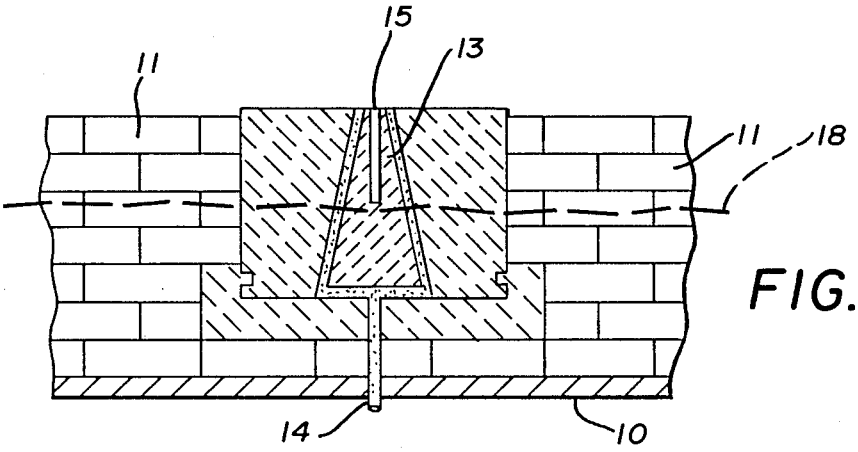
FIG. 4 is an enlarged vertical section on line 4—4 of FIG. 1.
Figure 5:
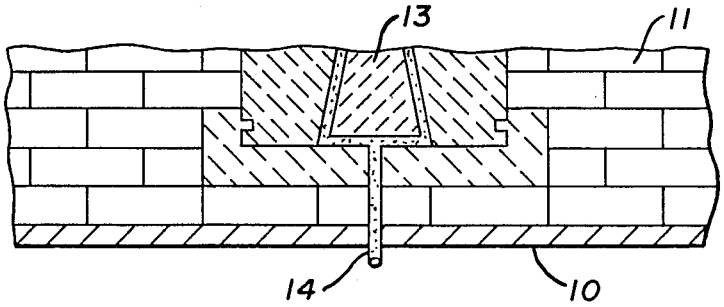
FIG. 5 is a vertical section of the device of FIG. 4 after erosion.
Figure 6:
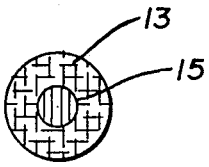
FIG. 6 is a view showing the visual appearance of the stirring plug of FIG. 1 when hot.
Figure 7:
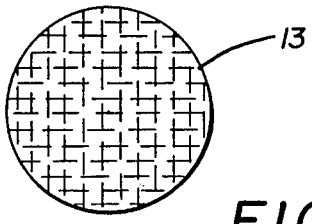
FIG. 7 is a view showing the visual appearance of the eroded stirring plug of FIG. 5 when hot.

By referring now to FIGS. 3 and 4 of the drawings, it will be seen that broken lines 17 and 18 respectively extends across the figures substantially horizontally indicating the degree of erosion of the refractory bodies 12 and 13 that is necessary to change the visual appearance of the devices due to the erosion and/or melting away of the metal rods 15 and indicating the remaining thickness of the refractory bodies 12 and 13 as well as the lining 11 that remains in the metallurgical vessel 10. By referring to FIG. 5 of the drawings, a vertical section of the stirring plug 13 and its assembled refractory parts in the lining 11 of the vessel 10 may be seen when the several parts of the device and the lining 11 have been eroded and all of the metal rods of the stirring plug 13 has been melted away. In FIG. 6 of the drawings, the visual appearance of the upper end of the stirring plug 13 and the metal rod 15 therein are shown as they appear when heated with the refractory of the stirring plug 13 being yellow and the end of the rod 15 being red. In FIG. 7 of the drawings, the appearance of the remaining upper end of the eroded stirring plug body 13 may be seen showing its overall yellow color and the absence of the bulls eye like configuration that existed when the metal rod 15 was present.

It will thus be seen that a simple relatively inexpensive and easily installed refractory erosion visual indicator and a method of using it has been disclosed. The indicator comprising a refractory body of an appropriate shape with a metal rod positioned in a portion thereof inwardly from the surface of the body that comes in contact with molten metal and a metallurgical vessel. The metal rods extending inwardly of the refractory body to a pre-determined point corresponding with a remaining pre-determined thickness of the refractory body. In a typical stirring plug application of the invention, a plug approximately 15 inches in height is provided with a central bore on the axis thereof of approximately 9½ inches in depth and a 7/16 inch diameter stainless steel rod approximately 9½ inches long is positioned in the bore and preferably cemented therein with a suitable ceramic mortar. The area of the stirring plug below the inner end of the stainless steel rod is approximately 5½ inches thick and when the refractory body and the metal rod have been eroded and/or melted away to this point the visual absence of the metal rod when the device is observed clearly indicates that it is time to exchange the stirring unit as there is only approximately 5½ inches of the plug remaining. The refractory of the plug and that of the lining of the metallurgical vessel may have substantially the same erosion rate or they may be different with the lining having a more resistive erosion rate. Those skilled in the art will observe that impact pads used in metallurgical vessels and against which the flowing stream of molten metal is engaged are generally used and prolong the life of the lining of the vessel by providing a replaceable pad. The present invention enables the degree of erosion of the impact pad to be readily determined by visual observation as hereinbefore described. Those skilled in the art will observe that if desired individual metal rods may be positioned in the refractory lining of the metallurgical vessel in the bottom and the side wall portions thereof as desired where they will work in the same way in providing visual indication of the remaining thickness of the refractory lining and visually indicate the need of relining. The method of using the device of the invention incorporates the visual observation of the changing appearance of the parts of the invention as hereinbefore described. As the safe indication of the device is formed by the center red metal rod in the yellow refractory body while the substantially eroded device is visually indicated by the yellow refractory appearance without the red dot or bulls eye.

Although but one embodiment of the present invention has been illustrated and described, it will be apparent to those skilled in the art that various changes and modifications may be made therein without departing from the spirit of the invention and having thus described our invention, what we claim is:

1. A refractory erosion visual indicator for a metallurgical vessel having a refractory lining comprising a refractory body of a known thickness positioned in said lining and having a surface facing the interior of said vessel, indicia means in said refractory body facing the interior of said vessel, said indicia means comprising at least one metal rod extending inwardly of said surface of said refractory body a predetermined length less than the known thickness of said refractory body, said rod arranged so that an end or a section thereof defines a visual dot surrounded by refractory, the rod adapted to become red hot and the refractory there-around adapted to contrast in color when subjected to molten metal.

2. The indicator of claim 1 wherein the refractory body takes the form of a stirring plug.

3. The indicator of claim 1 wherein the refractory body takes the form of an impact pad.

4. The indicator of claim 1 wherein the metal rod extends inwardly at a right angle to the surface of said refractory body a predetermined length and the refractory body is of a predetermined thickness beyond the inner end of the metal rod.

5. The method of determining the thickness of a refractory body in the lining of a metallurgical vessel having a metal member partially embedded in said body for visual inspection wherein the observable presence of said member indicates a satisfactory thickness and the observable absence of said member indicates a remaining thickness requiring replacement.

6. The method of determining the thickness of a refractory lining in a metallurgical vessel having a metal member located in said lining for visual inspection wherein the observable presence of said member indicates a satisfactory thickness of said lining and the observable absence of said member indicates an unsatisfactory thickness of said lining and the need of relining said vessel.

7. The method of claim 5 wherein the refractory body in the lining of the metallurgical vessel and the metal member partially embedded therein each change to different colors when subjected to molten metal and the different colors are visually observable and the absence of one color indicates a remaining thickness of the refractory body requiring replacement.

8. The method of claim 5 wherein the metal member changes to red color when red hot and the refractory body changes to yellow color when hot.

* * * * *